United States Patent [19]

Skarstad

[11] Patent Number: 4,840,535

[45] Date of Patent: Jun. 20, 1989

[54] VERTICAL SUBMERSIBLE PUMP ASSEMBLY

[75] Inventor: Torgeir Skarstad, Spikkestad, Norway

[73] Assignee: Kvaerner-Eureka A/S, Tranby, Norway

[21] Appl. No.: 146,129

[22] Filed: Jan. 20, 1988

[30] Foreign Application Priority Data

Oct. 26, 1987 [NO] Norway ..... 874457

[51] Int. Cl.[4] ..... F01D 25/32

[52] U.S. Cl. ..... 415/168.2; 415/98

[58] Field of Search ..... 415/168, 169 R, 169 A, 415/121 A, 97, 98, 101, 102, 110, 111

[56] References Cited

U.S. PATENT DOCUMENTS

| | | | |
|---|---|---|---|
| 1,334,461 | 3/1920 | Kerr | 415/98 |
| 2,257,867 | 10/1941 | Thrush | 415/98 |
| 2,514,865 | 7/1950 | Hornschuch | 415/111 |
| 3,457,869 | 7/1969 | Janetz | 415/98 |
| 4,563,124 | 1/1986 | Eskew | 415/102 |
| 4,643,652 | 2/1987 | Eberhardt | 415/98 |

*Primary Examiner*—Robert E. Garrett
*Assistant Examiner*—John T. Kwon
*Attorney, Agent, or Firm*—Young & Thompson

[57] ABSTRACT

The invention relates to a vertical submersible pump assembly comprising a centrifugal pump assembly which comprises a centrifugal pump with a rotor and a pump casing, and a drive motor connected with the pump rotor by a drive shaft. A drain chamber surrounds the drive shaft and is sealed off in the direction of the pump rotor and the drive motor by the aid of respective shaft seals. The invention is characterized by the fact that the centrifugal pump has a dual inlet, that the pump casing forms the bottom of the drain chamber and contains the seals against the pump rotor, and that the drain chamber is shaped with a pocket extending down into the upper casing inlet.

2 Claims, 1 Drawing Sheet

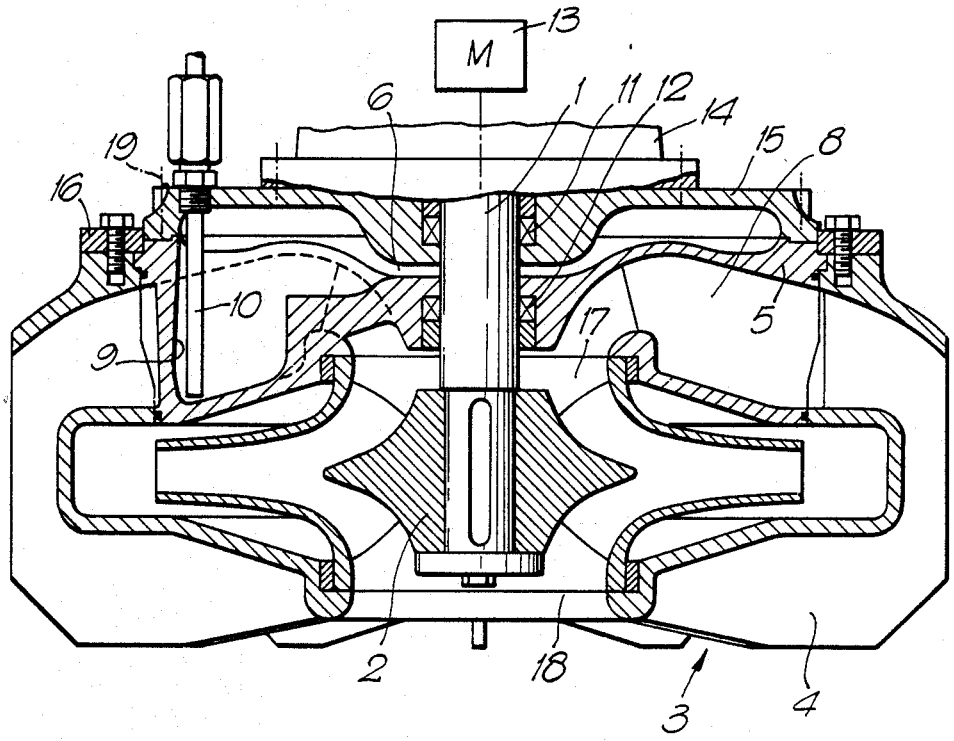
M
13
6
1
11
12
14
15
8
19
16
10
9
17
5
2
18
3
4

VERTICAL SUBMERSIBLE PUMP ASSEMBLY

The invention relates to a vertical submersible pump assembly comprising a centrifugal pump with a rotor and a pump casing, and a drive motor connected with the pump rotor by the aid of a drive shaft, with a drain chamber surrounding the drive shaft and being sealed in the direction of the pump rotor, and the drive motor by respective shaft sealing means.

The object of the drain chamber is to catch any leakage from the load side as well as from the motor side. This is, preferably, achieved by maintaining a pressure in the drain chamber which causes a pressure drop from the load side as well as from the drive motor side. A comparatively large drain chamber is desirable for enabling it to absorb some leakage, and it is desirable to enable any leakage fluid to bleed off from the sealing areas, thus, to prepare the sealing means adjacent to the drain chamber.

It is an object of the invention to provide as compact a pump structure as possible and, at the same time to permit the drain chamber to be relatively large, also providing for bleed off of any leakage fluid so that vital members, i.e. especially sealing means adjacent to said drain chamber, are kept free from contact with the leakage fluid in the drain chamber.

According to the invention a vertical submersible pump assembly as mentioned above is thus characterized by the fact that the centrifugal pump comprises a dual inlet, that the pump casing forms the bottom of the drain chamber and contains the seal against the pump rotor, and that the drain chamber is designed with a pocket extending down into the upper inlet.

By such a design a compact and efficient pump assembly is formed. The advantages of a dual inlet (upper and lower casing inlet) are known to those skilled in the art. With the lower sealing means placed in a portion of the pump casing which forms the bottom of the drain chamber a compact, especially short pump assembly is achieved, and an enlarged portion of the drain chamber may extend as pocket down into the upper casing inlet, where space is thus provided for such a pocket without necessitating an extension of the pump assembly in the axial direction.

The invention could be implemented in an especially advantageous manner by blocking one of the inlet channels formed between channel webs in the upper casing inlet.

BRIEF DESCRIPTION OF THE DRAWINGS

FIGURE of the Drawing showing a sectional view through the pump casing of a vertical submersible pump assembly.

A pump casing 3 mainly consists of a lower outside casing member 4, and an upper casing member 5. As shown, lower outer casing member 4 receives upper casing member 5 and said members are held together by a split fastening ring 16. Pump casing 3, more specifically, upper casing member 5 is by the aid of screws 19 connected with a bearing cover 15 which is, in turn, connected with a casing 14 in a manner not shown in detail. In casing 14 a hydraulic drive motor 13 is provided in a manner not shown in detail. Drive shaft 1 of drive motor 13 extends down through bearing cover 15, and further on, through upper pump casing member 5. On drive shaft 1 a pump rotor 2 is provided.

Pump rotor 2 is dual, i.e. it has an upper and a lower inlet 17 and 18, respectively.

Together with bearing cover 15 upper casing member 5 determines a drain chamber 6. An upper seal means 11 and a lower seal means 12, respectively, seal off againt drive shaft 1. As shown, upper seal means 11 is provided in bearing cover 15, whereas lower seal means 12 is placed in upper casing member 5. Upper casing member 5 is provided with a number of channel webs 8 forming a number of inlet channels into casing member 5. Said inlet channels open into upper inlet 17 of pump rotor 2. One of the channels formed between channel webs 8 is closed and opens upwards, as shown in left half of the Figure. In this manner a pocket 9 is formed. In this pocket leakage fluid may bleed off the area of drain chamber 6 around drive shaft 1. A riser 10 extends down into pocket 9 and may be utilized in a manner known per se to empty pocket 9, i.e. to empty the entire drain chamber. Such emptying may be carried out by using the riser as a suction pipe or, e.g. by pressurizing the chamber for short periods and thus blow collected leakage fluid up through riser 10. Such techniques are known to those skilled in the art and the necessary equipment is thus neither shown nor described.

It will be understood that the new pump assembly has a compact design, especially as seen in the axial direction, and that space present in upper casing member 5 is utilized in a suitable manner to form a pocket in connection with the drain chamber. Leakage fluid, i.e. load or lubricating oil/forced feed lubricating oil penetrating to drain chamber 6 past seal means 12 and 11, respectively, may bleed down into pocket 9 and the area adjacent the drive shaft is thus kept free of leakage fluid. Pocket 9 obviously permits various kinds of automatic or semi-automatic control or removal of leakage fluid through riser 10. Those skilled in the art will understand that a liquid level indicator connected to an alarm device may advantageously be provided in pocket 9. The fact that one of the inlet channels in upper casing member 5 is blocked will have no substantial effect on the work/efficiency of the pump.

Having described my invention, I claim:

1. A vertical submersible pump assembly, comprising a centrifugal pump assembly with a rotor, and a pump casing, and a drive motor connected with pump rotor by a drive shaft, with a drain chamber surrounding the drive shaft and being sealed off in the direction of the pump rotor, and the drive motor with respective shaft seal means, wherein the centrifugal pump has upper and lower inlets, the pump casing forms the bottom of the drain chamber and contains the seal means against the pump rotor, and the drain chamber is shaped as a downwardly closed pocket extending down into the upper pump inlet, and means extending down into said pocket to remove liquid from said pocket.

2. A vertical submersible pump assembly as defined in claim 1, wherein the upper casing inlet is provided with channel webs forming inlet channels, and that the pocket is formed in such an inlet channel.

* * * * *